US008860768B2

(12) United States Patent
Chen et al.

(10) Patent No.: US 8,860,768 B2
(45) Date of Patent: Oct. 14, 2014

(54) DISPLAY DEVICE AND METHOD FOR DRIVING SAME

(75) Inventors: Eddy Giing-Lii Chen, Miao-Li County (TW); Sheng-Tien Cho, Miao-Li County (TW)

(73) Assignee: Innolux Corporation, Miao-Li County (TW)

( * ) Notice: Subject to any disclaimer, the term of this patent is extended or adjusted under 35 U.S.C. 154(b) by 876 days.

(21) Appl. No.: 12/972,553

(22) Filed: Dec. 20, 2010

(65) Prior Publication Data

US 2011/0148947 A1 Jun. 23, 2011

(30) Foreign Application Priority Data

Dec. 23, 2009 (CN) ..... 2009 1 0312131

(51) Int. Cl.
*G09G 5/10* (2006.01)
*G09G 3/20* (2006.01)

(52) U.S. Cl.
CPC ..... *G09G 3/2025* (2013.01); *G09G 2320/0673* (2013.01); *G09G 2320/0261* (2013.01)
USPC ..... 345/690; 345/204; 345/698; 345/87

(58) Field of Classification Search
CPC ..... G09G 5/10
USPC ..... 345/87–104, 204–215, 690–699
See application file for complete search history.

(56) References Cited

U.S. PATENT DOCUMENTS

| | | | | |
|---|---|---|---|---|
| 6,396,469 | B1 | 5/2002 | Miwa et al. | |
| 7,893,917 | B2 * | 2/2011 | Baba et al. | 345/102 |
| 8,159,567 | B2 * | 4/2012 | Sugisawa et al. | 348/241 |
| 8,165,417 | B2 * | 4/2012 | Yamashita et al. | 382/274 |
| 8,520,032 | B2 * | 8/2013 | Ahn | 345/690 |
| 2005/0104842 | A1 * | 5/2005 | Baik | 345/102 |
| 2006/0262111 | A1 * | 11/2006 | Kerofsky | 345/211 |
| 2007/0103418 | A1 * | 5/2007 | Ogino et al. | 345/89 |
| 2007/0247407 | A1 * | 10/2007 | Lee et al. | 345/89 |
| 2008/0180375 | A1 * | 7/2008 | Wang | 345/89 |
| 2010/0002010 | A1 * | 1/2010 | Li et al. | 345/590 |
| 2010/0128067 | A1 * | 5/2010 | Lee | 345/690 |
| 2010/0245397 | A1 * | 9/2010 | Choe et al. | 345/690 |

* cited by examiner

*Primary Examiner* — Claire X Pappas
*Assistant Examiner* — Afroza Chowdhury
(74) *Attorney, Agent, or Firm* — Li & Cai Intellectual Property (USA) Office

(57) ABSTRACT

A display device includes a gray scale value counting module, a ratio generating module, a first sub-frame function module, a second sub-frame function module, and a display panel. The gray scale value counting module is configured for generating a gray scale value counting signal according to image data of each frame. The ratio generating module is configured for generating a ratio value signal according to the gray scale value counting signal. The first and second sub-frame function module are configured for generating first sub-frame image data and second sub-frame image data according to the ratio value signal and the image data respectively. The display panel is configured for displaying a first sub-frame image and a second sub-frame image according to the first and second sub-frame image data. A method for driving a display device is also provided.

20 Claims, 14 Drawing Sheets

DISPLAY DEVICE AND METHOD FOR DRIVING SAME

BACKGROUND

1. Technical Field

The present disclosure relates to a display device and a method for driving the same.

2. Description of the Related Art

Display devices are often driven by using a hold-type drive method, which may cause motion blur, reducing dynamic image quality of the display devices. Referring to FIG. 11, the solid line represents an actual brightness curve of the display devices using the hold-type drive method, and the broken line represents a viewing brightness curve of the conventional display devices using the hold-type drive method. The frame rate can be set to be 60 Hz; however, the display devices generate motion blur due to the viewing brightness values superimposing with the actual brightness values shown on the solid line.

A pulse-type drive method is often used on the display devices to improve the motion blur. Referring to FIG. 12, the solid line represents an actual brightness curve of the conventional display panels using the pulse-type drive method, and the broken line represents a viewing brightness value of the display devices using the pulse-type drive method. The frame rate can be still set to be 60 Hz; the average brightness values viewed by the user are close to the actual brightness values of the display devices, thus the display devices do not result in motion blur.

The general pulse-type driver method mainly uses a so-called black insertion technology. A single frame can be separated into two or more consecutive and adjacent sub-frames by using the black insertion technology, in which the earlier sub-frame is a bright frame and the later sub-frame is a black frame corresponding to a black image. Also referring to FIG. 13, F(n), F(n+1), and F(n+2) represent three consecutive frames, among them, each frame corresponds to two sub-frames. For example, frame F(n) corresponds to sub-frames F(n)_1 and F(n)_2, frame F(n+1) corresponds to sub-frames F(n+1)_1 and F(n+1)_2, and frame F(n+2) corresponds to sub-frames F(n+2)_1 and F(n+2)_2, among them, F(n)_2, F(n+1)_2, and F(n+2)_2 are the black sub-frames in the black insertion technology.

FIG. 14 shows a schematic view illustrating brightness of all the frames and the sub-frames shown in the FIG. 12. Provided that the frame rates of the frames F(n), F(n+1), and F(n+2) are set as 60 Hz, then the frame rates of the sub-frames F(n)_1, F(n)_2, F(n+1)_1, F(n+1)_2, F(n+2)_1 and F(n+2)_2 are 120 Hz. The black sub-frames F(n)_2, F(n+1)_2, and F(n+2)_2 respectively have low brightness in their corresponding frames F(n), F(n+1), and F(n+2), so that each black sub-frame is inserted between two bright sub-frames. Thus, the display devise can display images with double frame rate and alternately dark and bright sub-frames, resulting in elimination of motion blur.

However, since the bright sub-frame and the black sub-frame as a single frame are displayed sequentially, there is an obvious brightness difference, namely flicker, on the screen. Thus, even though motion blur is eliminated, image quality is reduced due to flicker phenomenon.

What is needed, therefore, is a display device and a method for driving the display device, which can overcome the described limitations.

SUMMARY

An aspect of the disclosure relates to a display device including a gray scale value counting module, a ratio generating module, a first sub-frame function module, a second sub-frame function module, and a display panel. The gray scale value counting module is configured for generating a gray scale value counting signal according to the image data of each frame. The ratio generating module is configured for receiving the gray scale value counting signal and generating a ratio value signal according to the gray scale value counting signal. The first sub-frame function module is configured for receiving the image data of each frame and the ratio value signal, creating a first gamma curve function according to a first formula and the ratio value signal, and generating first sub-frame image data according to the first gamma curve function and the image data of each frame. The second sub-frame function module is configured for receiving the image data of each frame and the ratio value signal, creating a second gamma curve function according to a second formula and the ratio value signal, and generating second sub-frame image data according to the second gamma curve function and the image data of each frame. The display panel configured for displaying a first sub-frame image according to the first sub-frame image data and displaying a second sub-frame image according to the second sub-frame image data. The first formula is $F1(g)=x\cdot f1(g)+(1-x)\cdot f1(g)'$, and the second formula is $F2(g)=x\cdot f2(g)+(1-x)\cdot f2(g)'$, where x represents a ratio value of the ratio value signal, 0x1, $F1(g)$ represents the first gamma curve function, $F2(g)$ represents the second gamma curve function, $f1(g)$ represents a first gamma curve sub-function, $f2(g)$ represents a second gamma curve sub-function, $f1(g)'$ represents a third gamma curve sub-function, and $f2(g)'$ represents a fourth gamma curve sub-function. A gamma value of the display device corresponds to an original gamma curve function, the $f1(g)$ and the $f2(g)$ are separated from the original gamma curve function according to a first predetermined average gray scale value, the first predetermined average gray scale value are greater than a minimum gray scale value of the original gamma curve function and less than a maximum gray scale value of the original gamma curve function, the $f1(g)$ and the $f2(g)$ have no intersection point in the range from greater than the minimum gray scale value to less than the maximum gray scale value. the $f1(g)'$ and the $f2(g)'$ are separated from the original gamma curve function according to the first predetermined average gray scale value, and the $f1(g)'$ and the $f2(g)'$ have an intersection point in the first predetermined average gray scale value.

An aspect of the disclosure relates to a method for driving a display device. The method includes: generating a gray scale value counting signal according to image data of a frame; generating a ratio value signal according to the gray scale value counting signal; creating a first gamma curve function according to a first formula and the ratio value signal; generating first sub-frame image data according to the first gamma curve function and the image data of the frame; creating a second gamma curve function according to a second formula and the ratio value signal; generating second sub-frame image data according to the second gamma curve function and the image data of the frame; and displaying a first sub-frame image according to the first sub-frame image data and displaying a second sub-frame image according to the second sub-frame image data. The first formula is $F1(g)=x\cdot f1(g)+(1-x)\cdot f1(g)'$, and the second formula is $F2(g)=x\cdot f2(g)+(1-x)\cdot f2(g)'$, where x represents a ratio value of the ratio value signal, 0x1, $F1(g)$ represents the first gamma curve function, $F2(g)$ represents the second gamma curve function, $f1(g)$ represents a first gamma curve sub-function, $f2(g)$ represents a second gamma curve sub-function, $f1(g)'$ represents a third gamma curve sub-function, and $f2(g)'$ represents a fourth gamma curve sub-function. A gamma value of the display device corresponds to an original gamma curve function, the f1(g) and the f2(g) are separated from the original gamma curve function according to a first predetermined average gray scale value, the first predetermined average gray scale value are greater than a minimum gray scale value of the original gamma curve function and less than a maximum gray scale value of the original gamma curve function, the f1(g) and the f2(g) have no intersection point in the range from greater than the minimum gray scale value to less than the maximum gray scale value. the f1(g)' and the f2(g)' are separated from the original gamma curve function according to the first predetermined average gray scale value, and the f1(g)' and the f2(g)' have an intersection point in the first predetermined average gray scale value.

BRIEF DESCRIPTION OF THE DRAWINGS

The components in the drawings are not necessarily drawn to scale, the emphasis instead placed upon clearly illustrating the principles of at least one embodiment. In the drawings, like reference numerals designate corresponding parts throughout the various views.

DETAILED DESCRIPTION

Reference will now be made to the drawings to describe certain exemplary embodiments of the present disclosure in detail.

Figure 1:
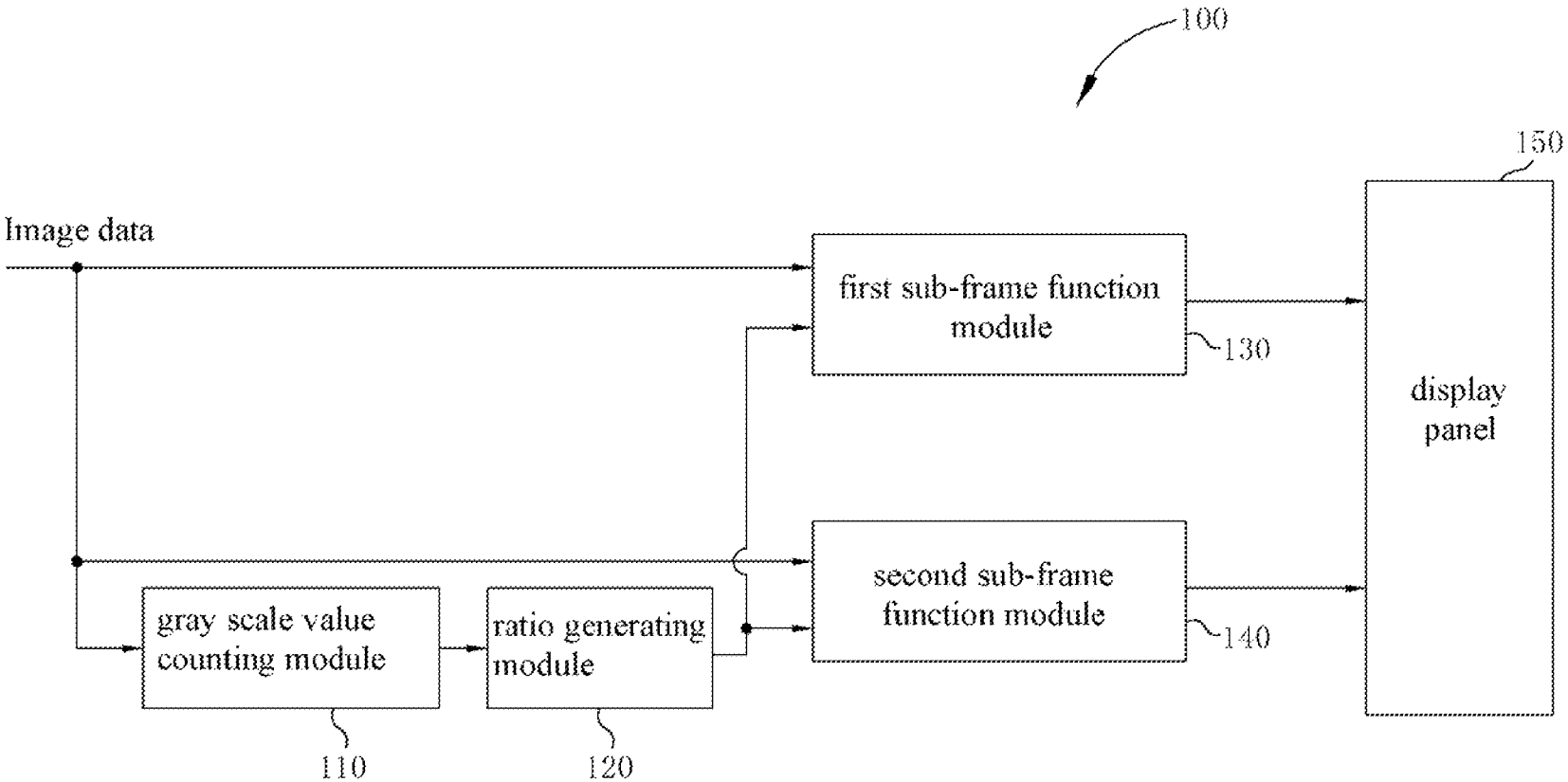
FIG. 1 is a partial block diagram of a display device according to an embodiment of the present disclosure, the display device including a gray scale value counting module.

FIG. 1 is a partial block diagram of a display device according to an embodiment of the present disclosure. The display device 100 includes a gray scale value counting module 110, a ratio generating module 120, a first sub-frame function module 130, a second sub-frame function module 140, and a display panel 150. The display panel 150 can be a liquid crystal panel.

The gray scale value counting module 110 is configured for receiving image data of each frame, generating a gray scale value counting signal according to the image data of each frame, and providing the gray scale value counting signal to the ratio generating module 120. The ratio generating module 120 is configured for receiving the gray scale value counting signal, generating a ratio value signal according to the gray scale value counting signal, and outputting the ratio value signal to the first sub-frame function module 130 and the second sub-frame function module 140.

The first sub-frame function module 130 is configured for receiving the image data of each frame and the ratio value signal, creating a first gamma curve function according to a first formula and the ratio value signal, and generating first sub-frame image data according to the first gamma curve function and the image data of each frame. In one example, the first formula can be $F1(g)=x\cdot f1(g)+(1-x)\cdot f1(g)'$, where x represents a ratio value of the ratio value signal, $0\leq x\leq 1$, F1(g) represents the first gamma curve function, f1(g) represents a first gamma curve sub-function, and f2(g) represents a second gamma curve sub-function.

Figure 2:
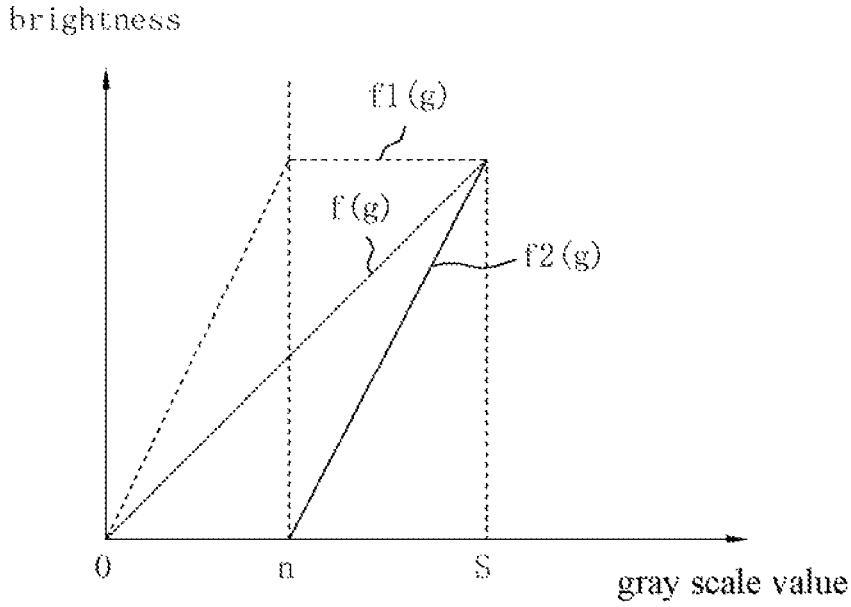
FIG. 2 is a schematic view illustrating for separating an original gamma curve function f(g) into a first gamma cure sub-function f1(g) and a second gamma cure sub-function f2(g) according to a first predetermined average gray scale value.

Referring to FIG. 2, the display device 100 may include a gamma value, and the gamma value corresponds to an original gamma curve function f(g) which shows a relationship between gray scale values and corresponding brightness of the display device 100. In the original gamma curve function f(g), the gray scale value is in the range from a minimum gray scale value 0 to a maximum gray scale value S. The f1(g) and the f2(g) are separated from the original gamma curve function f(g) according to a first predetermined average gray scale value n, the f1(g) and the f2(g) have no intersection point in the range from greater than the minimum gray scale value 0 to less than the maximum gray scale value S, and a brightness of the f1(g) is greater than that of the f2(g) in same gray scale value, where $f(g)=f1(g)+f2(g)$, and $0\leq n\leq S$. In one embodiment, the maximum gray scale value S can be 255, the first predetermined average gray scale value n can be 80.

Figure 3:
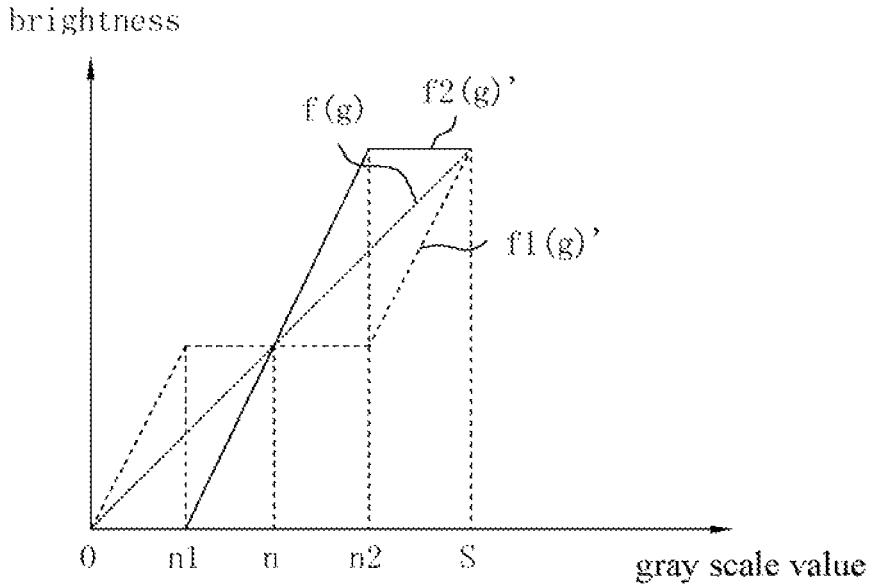
FIG. 3 is a schematic view illustrating for separating the original gamma curve function f(g) of FIG. 2 into a third gamma cure sub-function f1(g)' and a fourth gamma cure sub-function f2(g)' according to the first predetermined average gray scale value.

Referring to FIG. 3, the f1(g)' and the f2(g)' are also separated from the original gamma curve function f(g) according to the first predetermined average gray scale value n, however, the f1(g)' and the f2(g)' have one intersection point in the first predetermined average gray scale value n, where $f(g)=f1(g)'+f2(g)'$. Moreover, when the gray scale value is in the range from greater than the minimum gray scale value 0 to less than the first predetermined average gray scale value n, a brightness of the f1(g)' is greater than that of the f2(g)' in same gray scale value; when the gray scale value is in the range from greater than the first predetermined average gray scale value n to less than the maximum gray scale value S, a brightness of the f1(g)' is less than that of the f2(g)' in same gray scale value.

In operation, image data of a frame such as the Nth frame are provided to the gray scale value counting module 110, the first sub-frame function module 130, and the second sub-frame function module 140.

The gray scale value counting module 110 counts a present number of pixels in each frame with gray scale values less than a predetermined gray scale reference value according to the image data of the frame, and compares the present number with a predetermined pixel number. When the present number is less than the predetermined pixel number, the gray scale value counting module 110 outputs a gray scale value counting signal having a first value, and when the present number is greater than the predetermined pixel number, the gray scale value counting module 110 outputs a gray scale value counting signal having a second value. The display panel 150 includes a plurality of pixels, the predetermined pixel number can be greater than N*70%, where N represents a total number of the plurality of pixels of the display panel 150.

Figure 4:
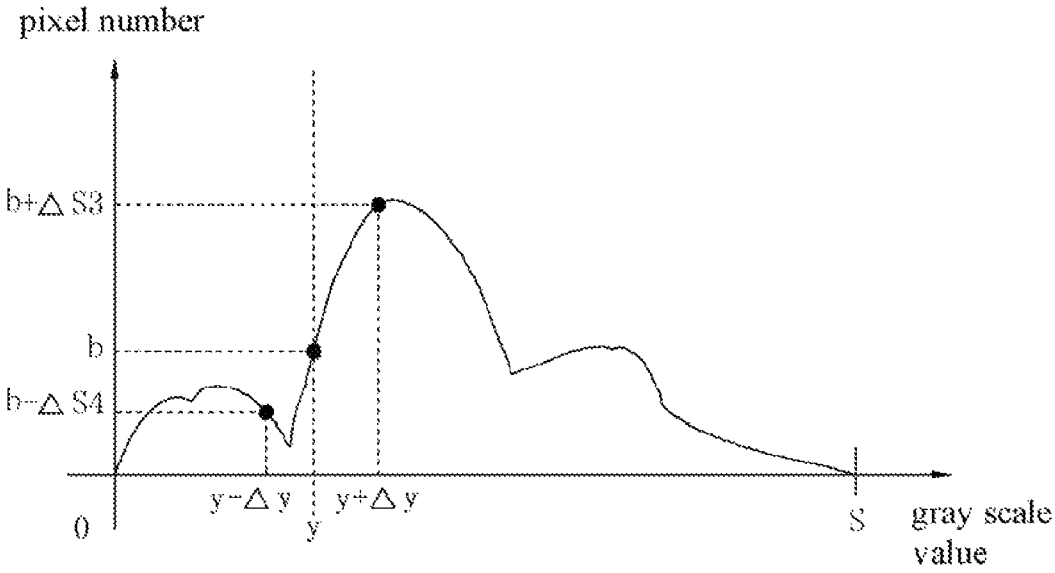
FIG. 4 and FIG. 5 show two gray scale value counting curves generated by the gray scale value counting module of FIG. 1, respectively.
Figure 5:
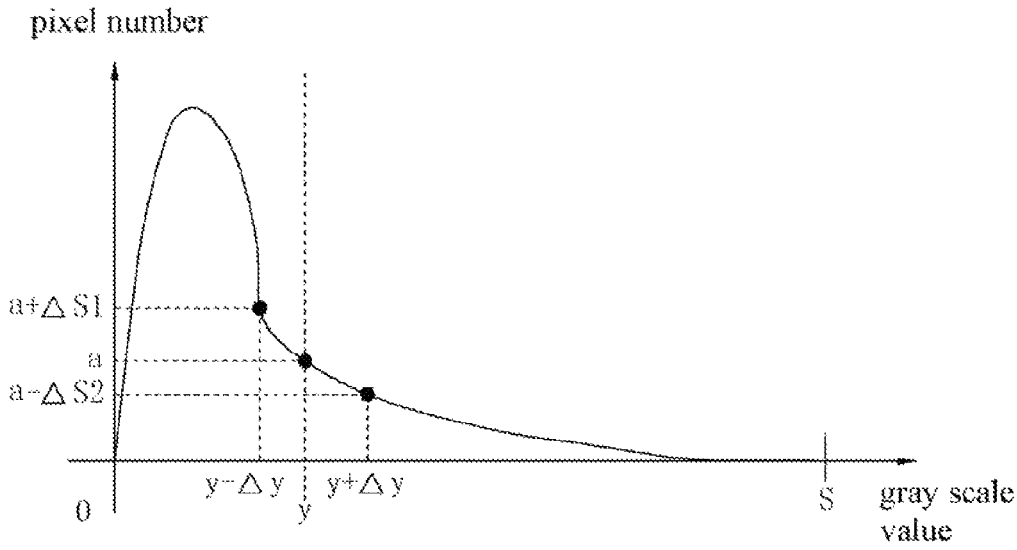

In one embodiment, the gray scale value counting module 110 can count the present number by use of generating a gray scale value counting curve of the image data of the frame. Referring to FIG. 4 and FIG. 5, two gray scale value counting curves corresponding to different image data are taken as two examples, and are shown respectively. Assuming the predetermined gray scale reference value is a gray scale value y. The gray scale value counting curve, the horizontal coordinate axis, and a vertical axis located at the gray scale value y cooperatively define an area, and the area can represent the present number of pixels with gray scale values less than the predetermined gray scale reference value y in the frame, therefore, the present number can be obtained by computing area of the area.

In the FIG. 4, a number of pixels with gray scale value y is b, the number of pixels with a gray scale value (y+Δy) is (b+Δs3), and a number of pixels with a gray scale value (y−Δy) is (b−Δs4). In the FIG. 5, a number of pixels with a gray scale value y is a; a number of pixels with a gray scale value (y+Δy) is (a−Δs2), and a number of pixels with a gray scale value (y−Δy) is (a+Δs1). Compare the area defined in FIG. 4 with the area defined in FIG. 5, it can be found that the image data corresponding to the gray scale value counting curve of FIG. 4 may have less pixels with gray scale values less than the predetermined gray scale reference value y, and the image data corresponding to the gray scale value counting curve of FIG. 5 may have more pixels with gray scale values more than the predetermined gray scale reference value y. That is, the present number defined in FIG. 4 may be less than the predetermined pixel number, and the present number defined in FIG. 5 may be greater than the predetermined pixel number. Accordingly, according to the image data corresponding to the gray scale value counting curve of FIG. 4, the gray scale value counting module 110 outputs the gray scale value counting signal having a first value to the ratio generating module 120, and according to the image data corresponding to the gray scale value counting curve of FIG. 5, the gray scale value counting module 110 outputs the gray scale value counting signal having a second value to the ratio generating module 120.

The ratio generating module 120 receives the gray scale value counting signal outputted by the gray scale value counting module 110 and provides a ratio value signal to the first sub-frame function module 130 and the second sub-frame function module 140. Specially, the ratio generating module 120 may store a present ratio value, a minimum ratio value, and a maximum ration value within the ratio generating module.

When the ratio generating module 120 receives the gray scale value counting signal acquiring the first value, the ratio generating module 120 compares the present ratio value with the maximum ratio value, if the present ratio value is equal to the maximum ratio value, the ratio generating module 120 outputs the ratio value signal with the present ratio value; otherwise, the ratio generating module 120 outputs the ratio value signal with a first adjusting ratio value greater than the present ratio value and replaces the present ratio value with the first adjusting ratio value.

When the ratio generating module 120 receives the gray scale value counting signal acquiring the second value, the ratio generating module 120 compares the present ratio value with the minimum ratio value, if the present ratio value is equal to the minimum ratio value, the ratio generating module 120 outputs the ratio value signal with the present ratio value; otherwise, the ratio generating module 120 outputs the ratio value signal with a second adjusting ratio value less than the present ratio value and replaces the present ratio value with the second adjusting ratio value.

Figure 6:
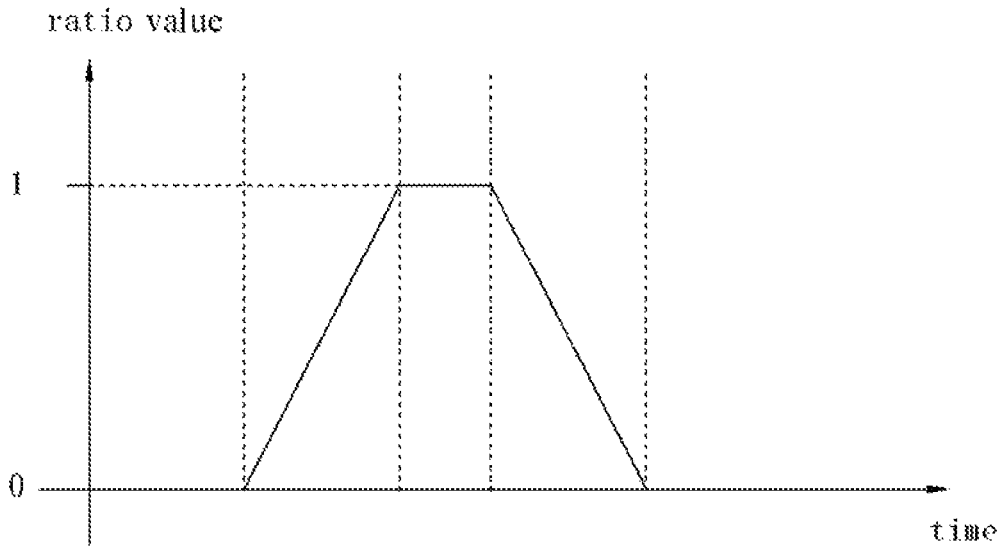
FIG. 6 shows a schematic diagram of a vary curve of ratio value determined by the ratio generating module of FIG. 1.

In one embodiment, the minimum ratio value and the maximum ration value are 0 and 1 respectively, a difference between the first adjusting ratio value and the present ratio value can be set as a fixed unit (such as 0.01), and a difference between the second adjusting ratio value and the present ratio value also can be set as the fixed unit. Referring to FIG. 6, a schematic diagram of a vary curve of the ratio value determined by the ratio generating module 120 is shown. Because both of the difference between the first adjusting ratio value and the present ratio value and the difference between the second adjusting ratio value and the present ratio value are set as the fixed unit, the ratio value can not be changed from 0 to 1 (or from 1 to 0) suddenly.

The first sub-frame function module 130 receives the ratio value signal outputted by the ratio generating module 120, obtains a first gamma curve function F1(*g*) according a ratio value of the ratio value signal according to the first formula $F1(g)=x\cdot f1(g)+(1-x)\cdot f1(g)'$, and generates first sub-frame image data according to the image data of the frame and the first gamma curve function F1(*g*).

Figure 7:
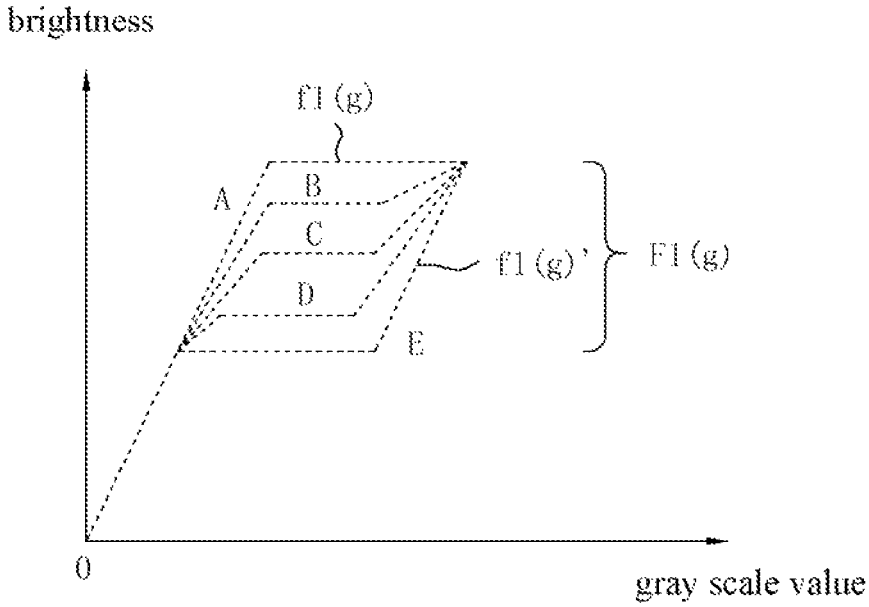
FIG. 7 shows five different gamma curve functions generated by the first sub-frame function module of FIG. 1.

From above descriptions, it can be found that, due to variations of the ratio values, the first sub-frame function module 130 may obtain different gamma curve functions as the first gamma curve function F1(*g*). Referring to FIG. 7, five different gamma curve functions generated by the first sub-frame function module 130 are taken as examples, and the five gamma curve functions can be labeled as A-curve, B-curve, C-curve, D-curve and E-curve. For example, when the ratio value is 1, the f1(*g*) (A-curve of FIG. 7) is defined as the first gamma curve function F1(*g*), and when the ratio value is 0, the f1(*g*)' (E-curve of FIG. 7) is defined as the first gamma curve function F1(*g*). That is to say, percentages of the f1(*g*) and the f1(*g*)' in the first gamma curve function F1(*g*) are determined by the ratio value of the ratio value signal.

The second sub-frame function module 140 receives the ratio value signal outputted by the ratio generating module 120, obtains a second gamma curve function F2(*g*) according a ratio value of the ratio value signal according to the second formula $F2(g)=x\cdot f2(g)+(1-x)\cdot f2(g)'$, and generates second sub-frame image data according to the image data of the frame and the second gamma curve function F2(*g*).

Figure 8:
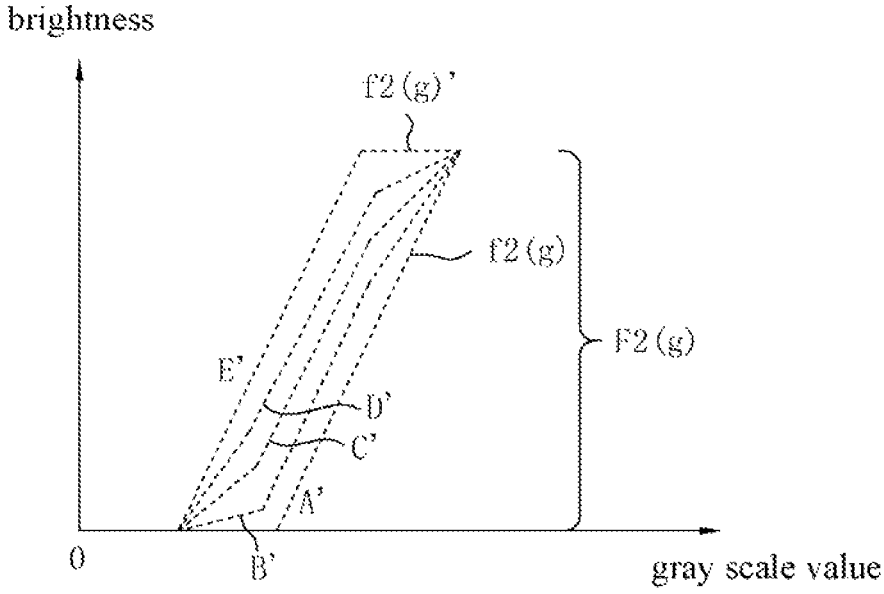
FIG. 8 shows five different gamma curve functions generated by the second sub-frame function module of FIG. 1.

According to the second formula, it can be found that, due to variations of the ratio values, the second sub-frame function module 140 may obtain different gamma curve functions as the second gamma curve function F2(*g*). Referring to FIG. 8, five different gamma curve functions generated by the second sub-frame function module 140 are taken as examples, and the five gamma curve functions can be labeled as A'-curve, B'-curve, C'-curve, D'-curve and E'-curve. For example, when the ratio value is 1, the f2(*g*) (A'-curve of FIG. 8) is defined as the second gamma curve function F2(*g*), and when the ratio value is 0, the f2(*g*)' (E'-curve of FIG. 8) is defined as the second gamma curve function F2(*g*). That is to say, percentages of the f2(*g*) and the f2(*g*)' in the second gamma curve function F2(*g*) are determined by the ratio value of the ratio value signal.

The display panel 150 consecutively displays a first sub-frame image and a second sub-frame image according to the first sub-frame image data and the second sub-frame image data. Specially, a relationship between gray scale values and brightness can be represented by the first gamma curve function F1(*g*) in the first sub-frame image, and a relationship between gray scale values and brightness can be represented by the second gamma curve function F2(*g*) in the second sub-frame image. A summation of the first gamma curve function F1(*g*) and the second gamma curve function F2(*g*) is the original gamma curve function f(g) of the display device 100.

In summary, the gray scale value counting module 110 outputs the gray scale value counting signal with different values by counting the gray scale values of the image data of each frame, such that the ratio generating module 120 generates the ratio value signal with a suitable ratio value and outputs the ratio value signal with the suitable ratio value to the first sub-frame function module 130 and the second sub-frame function module 140. The first sub-frame function module 130 and the second sub-frame function module 140 generate the first sub-frame image data and the second sub-frame image data by use of the first gamma curve function, the second gamma curve function, and the image data, such that the display panel 150 can correspondingly display the first sub-frame image and the second sub-frame image. Due to the ratio value signal with the suitable ratio value, the percentages of the f1(*g*) and the f1(*g*)' in the first gamma curve function F1(*g*) and the percentages of the f2(*g*) and the f2(*g*)' in the second gamma curve function F2(*g*) can be set as suitable percentages in order to reduce the brightness difference between the first gamma curve function F1(*g*) and the second gamma curve function F2(*g*). Thus, the flicker on the display panel 150 is improved.

Figure 9:
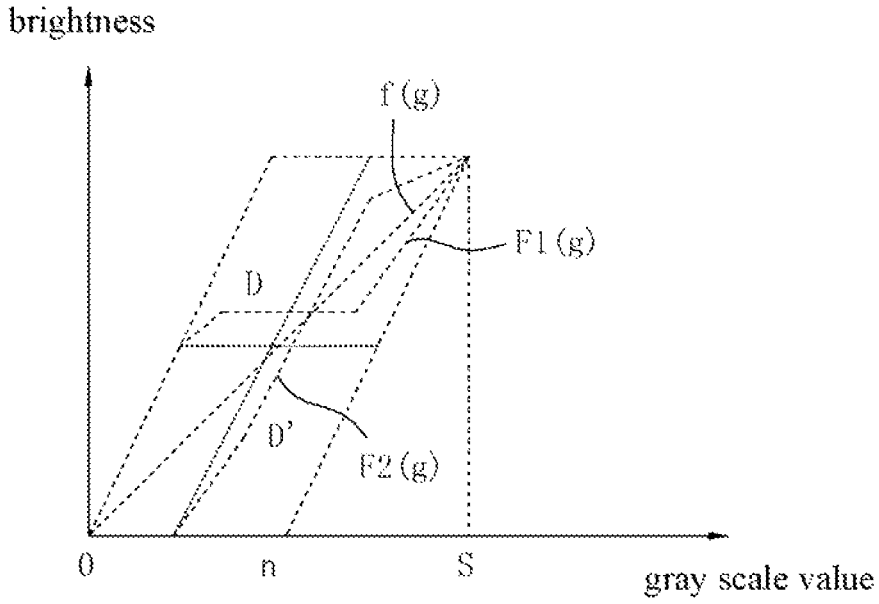
FIG. 9 shows an example of a first gamma curve function F1(g) and a second gamma curve function F2(g) generated by the first sub-frame function module and the second sub-frame function module of FIG. 1.

For example, referring to FIG. 9, when the first sub-frame function module 130 generates the D-curve as the first gamma curve function F1(*g*), and accordingly the second sub-frame function module 140 generates the D'-curve as the second gamma curve function F2(*g*), a brightness difference between the first gamma curve function F1(*g*) and the second gamma curve function F2(*g*) is small, such that the flicker on the display panel 150 is improved.

Moreover, because both of the difference between the first adjusting ratio value and the present ratio value and the difference between the second adjusting ratio value and the present ratio value are set as the fixed unit (such as 0.01), the ratio value can not be changed from 0 to 1 (or from 1 to 0) suddenly. Accordingly, the flicker on the display panel 150 can be further limited.

Figure 10:
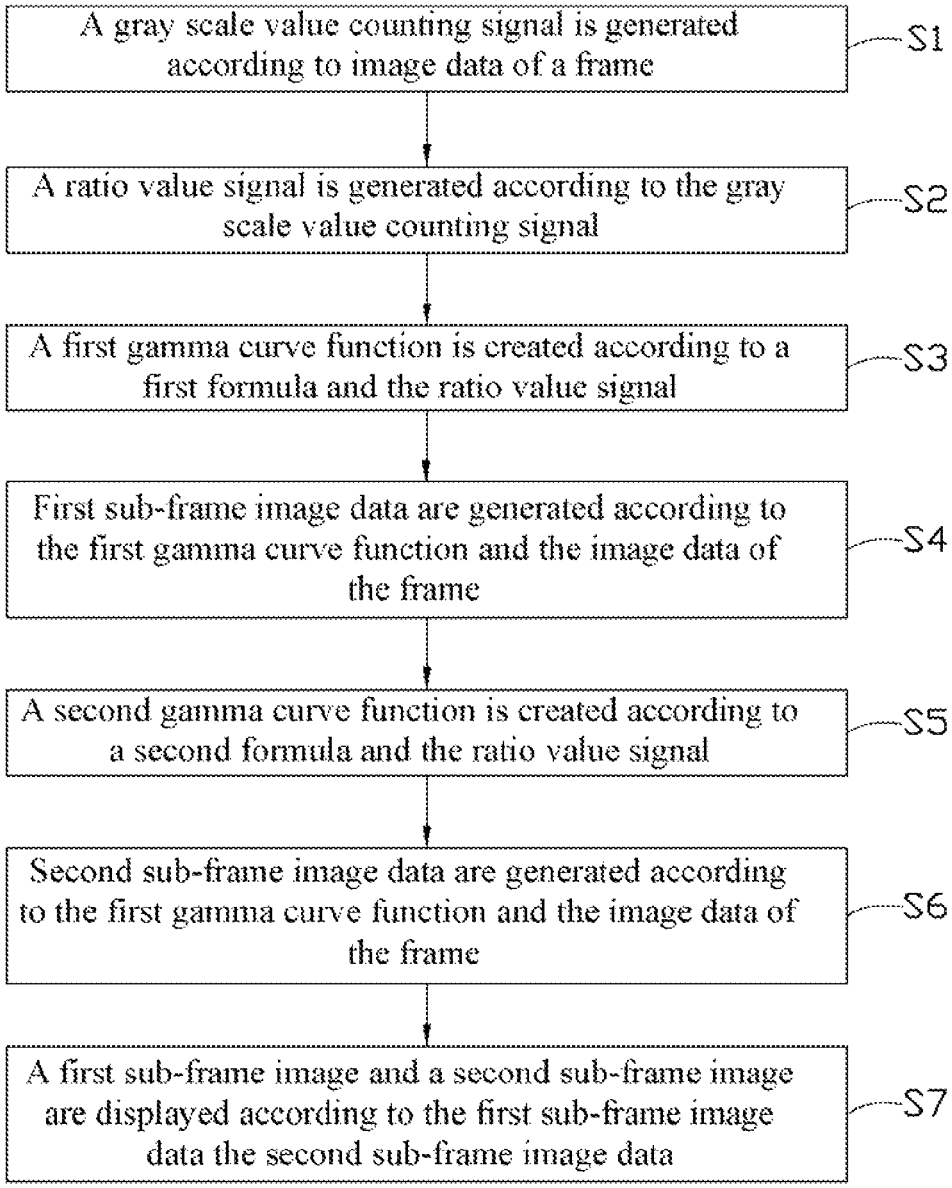
FIG. 10 is a flowchart of a method for driving a display device according to an embodiment of the present disclosure.
Figure 11:
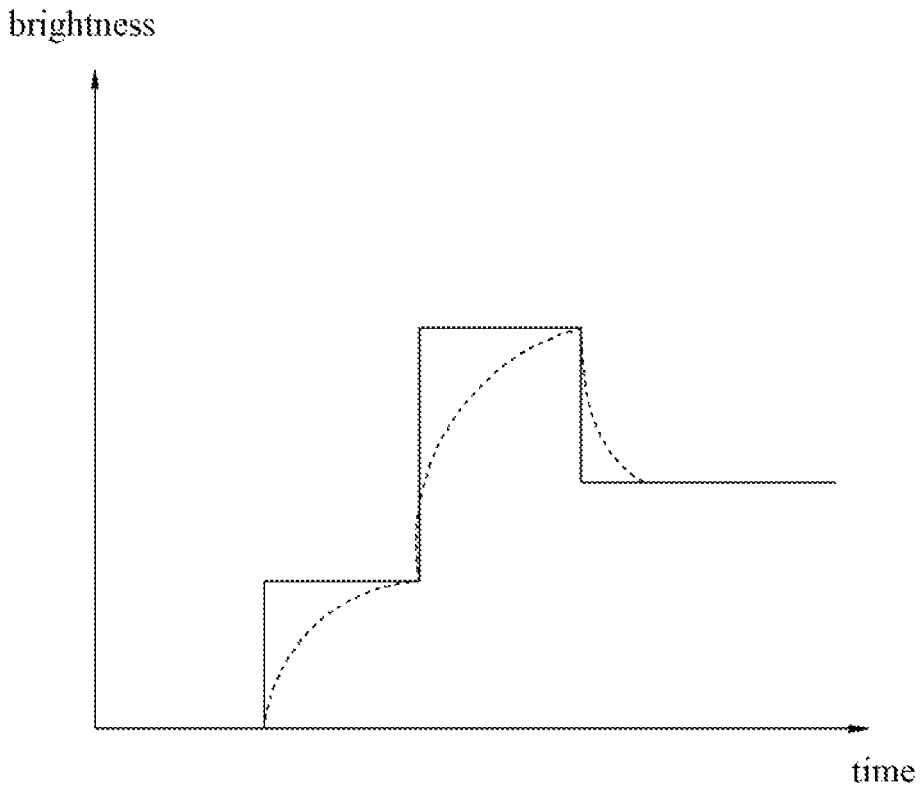
FIG. 11 (RELATED ART)
FIG. 11 shows a relationship between time and corresponding brightness values of a conventional display panel using holding-type method.
Figure 12:
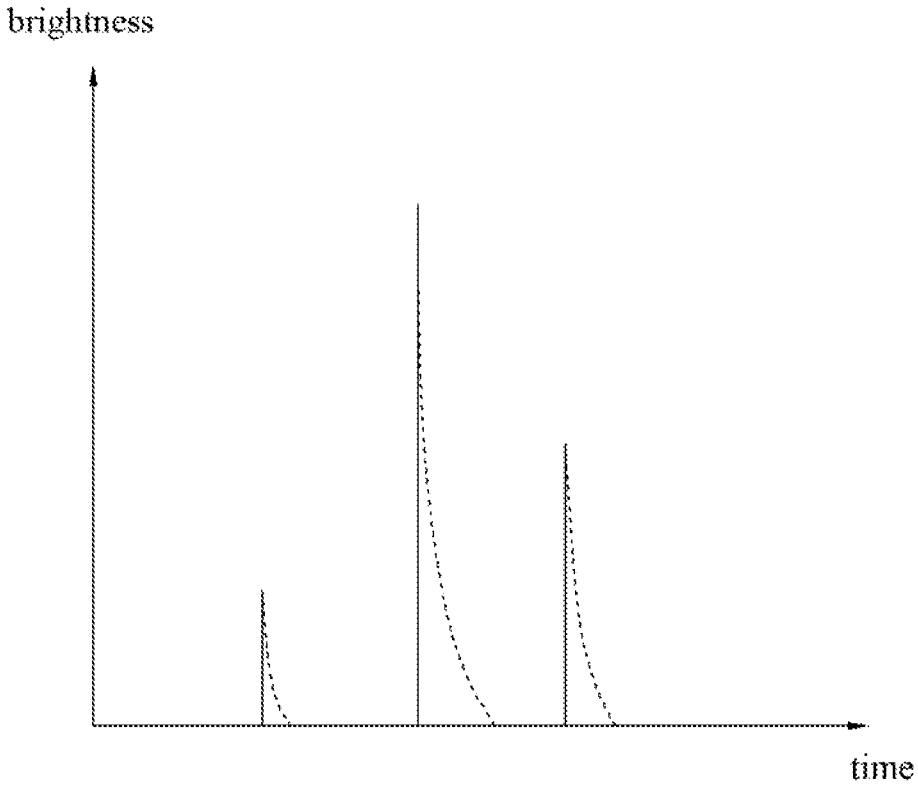
FIG. 12 (RELATED ART)
FIG. 12 shows a relationship between time and corresponding brightness values of the conventional display panel using pulse-type method.
Figure 13:
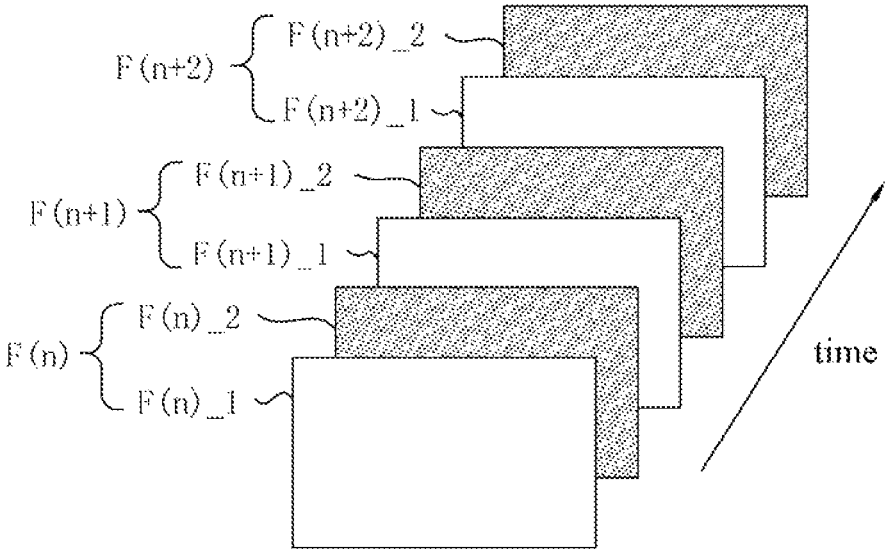
FIG. 13 (RELATED ART)
FIG. 13 is a schematic view showing a single frame generating two adjacent sub-frames using black frame insertion technology.
Figure 14:
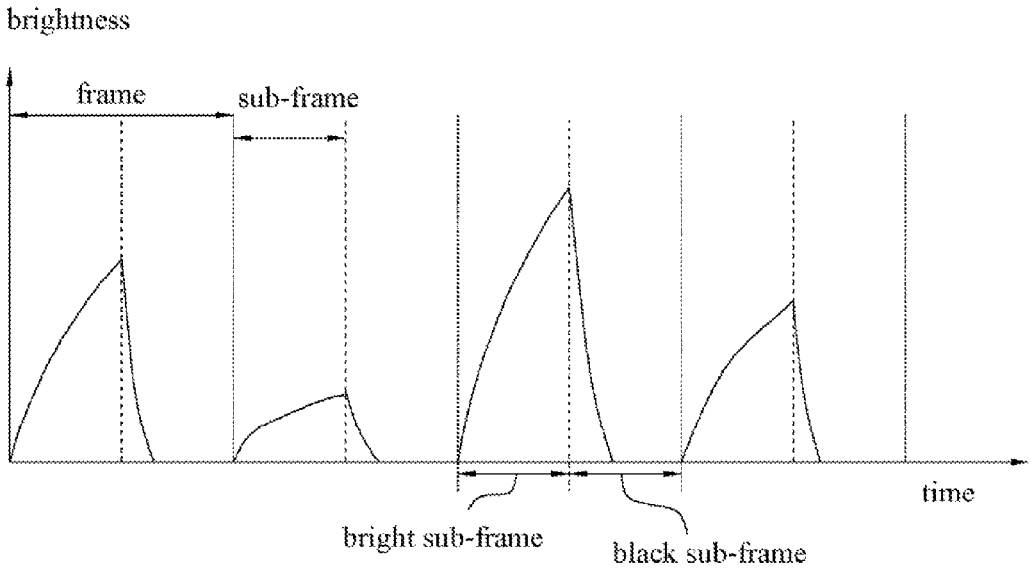
FIG. 14 (RELATED ART)
FIG. 14 is a schematic view illustrating brightness of all the frames and the sub-frames shown in FIG. 13.

Referring to FIG. 10, a method for driving a display device may include steps as follows. In step S1, a gray scale value counting signal according to image data of a frame is generated. In step S2, a ratio value signal is generated according to the gray scale value counting signal. In step S3, a first gamma curve function is created according to a first formula and the ratio value signal. In step S4, first sub-frame image data are generated according to the first gamma curve function and the image data of the frame. In step S5, a second gamma curve function is created according to a second formula and the ratio value signal. In step S6, second sub-frame image data are generated according to the first gamma curve function and the image data of the frame. In step S7, a first sub-frame image and a second sub-frame image are displayed according to the first sub-frame image data the second sub-frame image data.

In detail, the first formula is $F1(g)=x\cdot f1(g)+(1-x)\cdot f1(g)'$, the second formula is $F2(g)=x\cdot f2(g)+(1-x)\cdot f2(g)'$, where x represents a ratio value of the ratio value signal, $0\leq x\leq 1$, F1(*g*) represents the first gamma curve function, F2(*g*) represents the second gamma curve function, f1(*g*) represents a first gamma curve sub-function, f2(*g*) represents a second gamma curve sub-function, f1(*g*)' represents a third gamma curve sub-function, and f2(*g*)' represents a fourth gamma curve sub-function. A gamma value of the display device corresponds to an original gamma curve function. The f1(*g*) and the f2(*g*) are separated from the original gamma curve function according to a first predetermined average gray scale value, the first predetermined average gray scale value are greater than a minimum gray scale value of the original gamma curve function and less than a maximum gray scale value of the original gamma curve function, and the f1(*g*) and the f2(*g*) have no intersection point in the range from greater than the minimum gray scale value to less than the maximum gray scale value. The f1(*g*)' and the f2(*g*)' are separated from the original gamma curve function according to the first predetermined average gray scale value, and the f1(*g*)' and the f2(*g*)' have an intersection point in the first predetermined average gray scale value. A brightness of the f1(*g*) is greater than that of the f2(*g*) in same gray scale value. A brightness of the f1(*g*)' is greater than that of the f2(*g*)' in a gray scale value greater than the minimum gray scale value and less than the first predetermined average gray scale value, and a brightness of the f1(*g*)' is less than that of the f2(*g*)' in a gray scale value greater than the first predetermined average gray scale value and less than the maximum gray scale value. The minimum gray scale value and the maximum gray scale value are 0 and 255 respectively, and the predetermined gray scale reference value is 80.

In step S1, the gray scale value counting signal is generated by: counting a present number of pixels in the frame with gray scale values less than a predetermined gray scale reference value according to the image data of the frame; and comparing the present number with a predetermined pixel number. When the present number is less than the predetermined gray scale reference value, the gray scale value counting signal acquires a first value, and when the present number is greater than the predetermined gray scale reference value, the gray scale value counting signal acquires a second value. The predetermined pixel number is greater than N*70%, where N represents a total number of the plurality of pixels of the display panel.

In step S2, when the gray scale value counting signal acquires a first value, the ratio value signal is generated by comparing a present ratio value with a maximum ratio value. If the present ratio value is equal to the maximum ratio value, the ratio value signal with the present ratio value is generated; otherwise, the ratio value signal with a first adjusting ratio value greater than the present ratio value is generated. When the gray scale value counting signal acquires a first value, the ratio value signal is generated by: comparing a present ratio value with a minimum ratio value. If the present ratio value is equal to the minimum ratio value, the ratio value signal with the present ratio value is generated; otherwise, the ratio value signal with a second adjusting ratio value greater than the present ratio value is generated. The minimum ratio value and the maximum ratio value are 0 and 1 respectively. A difference between the first adjusting ratio value and the present ratio value can be 0.01, and a difference between the second adjusting ratio value and the present ratio value also can be 0.01.

It is to be further understood that even though numerous characteristics and advantages of a preferred embodiment have been set out in the foregoing description, together with details of the structures and functions of the embodiments, the disclosure is illustrative only; and that changes may be made in detail, especially in matters of shape, size and arrangement of parts within the principles of disclosure to the full extent indicated by the broad general meaning of the terms in which the appended claims are expressed.

What is claimed is:

1. A display device, comprising:

a gray scale value counting module, operatively receiving image data of each frame and generating a gray scale value counting signal according to the image data of each frame;

a ratio generating module coupled to the gray scale value counting module, operatively generating a ratio value signal according to the gray scale value counting signal;

a first sub-frame function module coupled to the ratio generating module, operatively receiving the image data of each frame and the ratio value signal, creating a first gamma curve function according to a first formula and the ratio value signal, and generating first sub-frame image data according to the first gamma curve function and the image data of each frame;

a second sub-frame function module coupled to the ratio generating module, operatively receiving the image data of each frame and the ratio value signal, creating a second gamma curve function according to a second formula and the ratio value signal, and generating second sub-frame image data according to the second gamma curve function and the image data of each frame; and a display panel coupled to the first sub-frame function module and the second sub-frame function module, operatively configured for displaying a first sub-frame image according to the first sub-frame image data and displaying a second sub-frame image according to the second sub-frame image data, wherein the first formula is $F1(g)=x\cdot f1(g)+(1-x)\cdot f1(g)'$, the second formula is $F2(g)=x\cdot f2(g)+(1-x)\cdot f2(g)'$, where x represents a ratio value of the ratio value signal, $0\leq x\leq 1$, $F1(g)$ represents the first gamma curve function, $F2(g)$ represents the second gamma curve function, $f1(g)$ represents a first gamma curve sub-function, $f2(g)$ represents a second gamma curve sub-function, $f1(g)'$ represents a third gamma curve sub-function, and $f2(g)'$ represents a fourth gamma curve sub-function, wherein a gamma value of the display device corresponds to an original gamma curve function, the $f1(g)$ and the $f2(g)$ are separated from the original gamma curve function according to a first predetermined average gray scale value, the first predetermined average gray scale value are greater than a minimum gray scale value of the original gamma curve function and less than a maximum gray scale value of the original gamma curve function, the $f1(g)$ and the $f2(g)$ have no intersection point in the range from greater than the minimum gray scale value to less than the maximum gray scale value, the $f1(g)'$ and the $f2(g)'$ are separated from the original gamma curve function according to the first predetermined average gray scale value, and the $f1(g)'$ and the $f2(g)'$ have an intersection point in the first predetermined average gray scale value.

2. The display device of claim 1, wherein a brightness of the $f1(g)$ is greater than that of the $f2(g)$ in same gray scale value, a brightness of the $f1(g)'$ is greater than that of the $f2(g)'$ in a gray scale value greater than the minimum gray scale value and less than the first predetermined average gray scale value, and a brightness of the $f1(g)'$ is less than that of the $f2(g)'$ in a gray scale value greater than the first predetermined average gray scale value and less than the maximum gray scale value.

3. The display device of claim 1, wherein the gray scale value counting module counts a present number of pixels in each frame with gray scale values less than a predetermined gray scale reference value according to the image data of each frame, and compares the present number with a predetermined pixel number, when the present number is less than the predetermined gray scale reference value, the gray scale value counting signal acquires a first value, and when the present number is greater than the predetermined gray scale reference value, the gray scale value counting signal acquires a second value.

4. The display device of claim 3, wherein the minimum gray scale value and the maximum gray scale value are 0 and 255 respectively, and the predetermined gray scale reference value is 80.

5. The display device of claim 3, wherein the display panel comprises a plurality of pixels, the predetermined pixel number is greater than N*70%, where N represents a total number of the plurality of pixels of the display panel.

6. The display device of claim 3, wherein the ratio generating module comprises a present ratio value, a minimum ratio value, and a maximum ration value, and the present ratio value, the minimum ratio value, and the maximum ration value are stored within the ratio generating module.

7. The display device of claim 6, wherein when the ratio generating module receives the gray scale value counting signal acquiring the first value, the ratio generating module compares the present ratio value with the maximum ratio value, if the present ratio value is equal to the maximum ratio value, the ratio generating module outputs the ratio value signal with the present ratio value; otherwise, the ratio generating module outputs the ratio value signal with a first adjusting ratio value greater than the present ratio value and replaces the present ratio value with the first adjusting ratio value.

8. The display device of claim 7, wherein when the ratio generating module receives the gray scale value counting signal acquiring the second value, the ratio generating module compares the present ratio value with the minimum ratio value, if the present ratio value is equal to the minimum ratio value, the ratio generating module outputs the ratio value signal with the present ratio value; otherwise, the ratio generating module outputs the ratio value signal with a second adjusting ratio value less than the present ratio value and replaces the present ratio value with the second adjusting ratio value.

9. The display device of claim 8, wherein a difference between the first adjusting ratio value and the present ratio value is 0.01, and a difference between the second adjusting ratio value and the present ratio value is 0.01.

10. The display device of claim 7, wherein the minimum ratio value and the maximum ration value are 0 and 1 respectively.

11. A method for driving a display device, comprising:

generating a gray scale value counting signal according to image data of a frame;

generating a ratio value signal according to the gray scale value counting signal;

creating a first gamma curve function according to a first formula and the ratio value signal;

generating first sub-frame image data according to the first gamma curve function and the image data of the frame;

creating a second gamma curve function according to a second formula and the ratio value signal;

generating second sub-frame image data according to the second gamma curve function and the image data of the frame; and displaying a first sub-frame image according to the first sub-frame image data and displaying a second sub-frame image according to the second sub-frame image data, wherein the first formula is $F1(g)=x\cdot f1(g)+(1-x)\cdot f1(g)'$, the second formula is $F2(g)=x\cdot f2(g)+(1-x)\cdot f2(g)'$, where x represents a ratio value of the ratio value signal, $0\leq x\leq 1$, $F1(g)$ represents the first gamma curve function, $F2(g)$ represents the second gamma curve function, $f1(g)$ represents a first gamma curve sub-function, $f2(g)$ represents a second gamma curve sub-function, $f1(g)'$ represents a third gamma curve sub-function, and $f2(g)'$ represents a fourth gamma curve sub-function, wherein a gamma value of the display device corresponds to an original gamma curve function, the $f1(g)$ and the $f2(g)$ are separated from the original gamma curve function according to a first predetermined average gray scale value, the first predetermined average gray scale value are greater than a minimum gray scale value of the original gamma curve function and less than a maximum gray scale value of the original gamma curve function, the $f1(g)$ and the $f2(g)$ have no intersection point in the range from greater than the minimum gray scale value to less than the maximum gray scale value, the $f1(g)'$ and the $f2(g)'$ are separated from the original gamma curve function according to the first predetermined average gray scale value, and the $f1(g)'$ and the $f2(g)'$ have an intersection point in the first predetermined average gray scale value.

12. The method of claim 11, wherein a brightness of the $f1(g)$ is greater than that of the $f2(g)$ in same gray scale value, a brightness of the $f1(g)'$ is greater than that of the $f2(g)'$ in a gray scale value greater than the minimum gray scale value and less than the first predetermined average gray scale value, and a brightness of the $f1(g)'$ is less than that of the $f2(g)'$ in a gray scale value greater than the first predetermined average gray scale value and less than the maximum gray scale value.

13. The method of claim 11, wherein the gray scale value counting signal is generated by:

counting a present number of pixels in the frame with gray scale values less than a predetermined gray scale reference value according to the image data of the frame; and comparing the present number with a predetermined pixel number, when the present number is less than the predetermined gray scale reference value, the gray scale value counting signal acquires a first value, and when the present number is greater than the predetermined gray scale reference value, the gray scale value counting signal acquires a second value.

14. The method of claim 13, wherein the minimum gray scale value and the maximum gray scale value are 0 and 255 respectively, and the predetermined gray scale reference value is 80.

15. The method of claim 13, wherein the display device comprises a plurality of pixels, the predetermined pixel number is greater than N*70%, where N represents a total number of the plurality of pixels of the display panel.

16. The method of claim 13, wherein when the gray scale value counting signal acquires a first value, the ratio value signal is generated by:

comparing a present ratio value with a maximum ratio value, if the present ratio value is equal to the maximum ratio value, the ratio value signal with the present ratio value is generated; otherwise, the ratio value signal with a first adjusting ratio value greater than the present ratio value is generated.

17. The method of claim 16, wherein a difference between the first adjusting ratio value and the present ratio value is 0.01.

18. The method of claim 16, wherein when the gray scale value counting signal acquires a second value, the ratio value signal is generated by:

comparing a present ratio value with a minimum ratio value, if the present ratio value is equal to the minimum ratio value, the ratio value signal with the present ratio value is generated; otherwise, the ratio value signal with a second adjusting ratio value less than the present ratio value is generated.

19. The method of claim 18, wherein a difference between the second adjusting ratio value and the present ratio value is 0.01.

20. The method of claim 18, wherein the minimum ratio value and the maximum ration value are 0 and 1 respectively.

* * * * *